US006509682B2

(12) United States Patent
Ishinagawa et al.

(10) Patent No.: US 6,509,682 B2
(45) Date of Patent: Jan. 21, 2003

(54) CATHODE RAY TUBE HAVING AN IMPROVED ELECTRON GUN

(75) Inventors: Shinichi Ishinagawa, Ichihara (JP); Yoshiaki Takahashi, Chiba (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 117 days.

(21) Appl. No.: 09/808,982

(22) Filed: Mar. 16, 2001

(65) Prior Publication Data

US 2001/0030505 A1 Oct. 18, 2001

(30) Foreign Application Priority Data

Mar. 16, 2000 (JP) ..... 2000-073369

(51) Int. Cl.[7] ..... H01J 31/00

(52) U.S. Cl. ..... 313/477 HC; 313/417; 313/482; 313/456

(58) Field of Search ..... 313/451, 476, 313/477 HC, 477, 477 R, 482, 456

(56) References Cited

U.S. PATENT DOCUMENTS 4,082,977 A * 4/1978 Blumenberg ..... 313/457
4,485,327 A * 11/1984 Misono ..... 313/414
4,933,598 A * 6/1990 Sudo et al. ..... 313/432
5,196,764 A * 3/1993 Kim et al. ..... 313/477 HC
5,430,350 A * 7/1995 Chen et al. ..... 313/456
6,078,134 A * 6/2000 Nose et al. ..... 313/477 HC

* cited by examiner

*Primary Examiner*—P. Austin Bradley
*Assistant Examiner*—Briggitte R. Hammond
(74) *Attorney, Agent, or Firm*—Antonelli, Terry, Stout & Kraus, LLP

(57) ABSTRACT

A cathode ray tube has an electron gun supported on a stem of a vacuum envelope having stem pins. The electron gun includes electrodes fixed on two bead glasses, and mount supports are embedded in end portions of the bead glasses for supporting the electron gun on the stem, and a supporting member connects one of the stem pins and one of the mount supports. The supporting member includes a plate-like portion, first and second bent portions bent from respective sides of the plate-like portion to form a generally C-shaped transverse cross section, the first bent portion is welded to the one of the mount supports, and the second bent portion is welded to the one of the stem pins. An axial length of the plate-like portion on its first-bent-portion side is longer than that on its second-bent-portion side.

5 Claims, 10 Drawing Sheets

CATHODE RAY TUBE HAVING AN IMPROVED ELECTRON GUN

BACKGROUND OF THE INVENTION

The present invention relates to a cathode ray tube, and in particular to a cathode ray tube capable of supporting an electron gun firmly within its neck portion.

Generally, an electron gun of a cathode ray tube is supported on a stem of the cathode ray tube and is fixed at a specified position within its neck portion by an electron gun supporting structure.

FIG. 5 is a schematic cross-sectional view of a conventional color cathode ray tube.

In FIG. 5, reference numeral 21 denotes a panel portion, 21F is a faceplate, 22 is a neck portion, 23 is a funnel portion, 24 is a phosphor screen, 25 is a shadow mask, 26 is an internal magnetic shield, 27 is a deflection yoke, 28 is a stem, 29 is a three-beam in-line type electron gun, 30 is an electron beam, and 50 is an internal graphite coating.

A (a glass bulb) vacuum envelope of the color cathode ray tube comprises the panel portion 21 having the generally rectangular faceplate 21F, the narrow cylindrical neck portion 22 housing the three-beam in-line type electron gun 29, and the generally truncated-cone shaped funnel portion 23 connecting the panel portion 21 and the neck portion 22. The phosphor screen 24 is formed on the inner surface of the faceplate 21F of the panel portion 21, and the shadow mask 25 having a large number of electron beam-transmissive apertures is fixed and closely spaced from the phosphor screen 24 within the panel portion 21. The internal magnetic shield 26 is disposed within the funnel portion 23, and the deflection yoke 27 is mounted around the outside of the funnel portion 23. The in-line type electron gun 29 is supported on the stem 28 by an electron gun supporting structure described subsequently, and three electron beams 30 (only one of which is shown in FIG. 5) emitted from the electron gun 29 are deflected and scanned horizontally and vertically by the deflection yoke 27, then pass through the electron beam-transmissive apertures in the shadow mask 25, and then impinge upon the phosphor screen 24.

The mechanism and operation of displaying a picture by the conventional cathode ray tube is well-known to those skilled in the art, and the explanation of those is omitted.

FIG. 6A is a broken-away side view of the neck portion 22 of the conventional color cathode ray tube housing the in-line type electron gun 29, FIG. 6B is an enlarged cross-sectional view of the neck portion 22 taken along line VIB—VIB of FIG. 6A, FIG. 6C is an enlarged cross-sectional view of a supporting member 36 taken along line VIB—VIB of FIG. 6A, and FIG. 6D is an enlarged cross-sectional view of the neck portion 22 taken along line VID—VID of FIG. 6A.

FIG. 7 is an enlarged side view of the in-line type electron gun 29 of FIG. 6A supported on the stem 28 by the electron gun supporting structure 38.

In FIGS. 6A to 6C and 7, reference numeral 31 denotes a cathode, reference character G1 is a beam control electrode, G2 is an accelerating electrode, G3 is a focus electrode, G4 is an anode, and reference numerals 33A and 33B are a pair of bead glasses. The cathode 31, the beam control electrode G1, the accelerating electrode G2, the focus electrode G3 and the anode G4 are coaxially fixed on the pair of bead glasses 33A, 33B with their respective support tabs embedded in the bead glasses 33A, 33B. Reference numeral 291 denotes a shield cup, 32 is a heater, 341, 342 and 343 are stem pins, 35A and 35B are mount supports, 36 is a supporting member, 37 are stem mounds. The same reference numerals as utilized in FIG. 5 designate corresponding elements in FIGS. 6A to 6D and 7.

FIG. 6D is an enlarged cross-sectional view of the neck portion 22 taken along line VID—VID of FIG. 6A, and illustrates an example of wiring between the stem pins and electrodes of the electron gun. The positions of the respective stem pins are arranged with an equal angular spacing of 25.7° on a pin circle of 15.24 mm in diameter, and the stem pins embedded in the respective stem pin positions are connected to the electrodes of the electron gun as shown in Table 1 below.

TABLE 1

| PIN POSITION NOS. | ELECTRODES OF the ELECTRON GUN |
|---|---|
| #1 | FOCUS ELECTRODE (when plural focus electrodes are employed) |
| #2 | FOCUS ELECTRODE G3 |
| #3 | no stem pin embedded |
| #4 | no stem pin embedded |
| #5 (Ref. No. 343) | BEAM CONTROL ELECTRODE G1 |
| #6 | CATHODE FOR GREEN ELECTRON BEAM |
| #7 | ACCELERATING ELECTRODE G2 |
| #8 (Ref. No. 342) | CATHODE FOR RED ELECTRON BEAM |
| #9 | HEATER |
| #10 | HEATER |
| #11 (Ref. No. 341) | CATHODE FOR BLUE ELECTRON BEAM |
| #12 | INTERNAL CONNECTION |
| #13 | no stem pin embedded |
| #14 | no stem pin embedded |

As is apparent from TABLE 1, a stem pin for applying a high voltage of 5 kV to 10 kV to an electrode such as the focus electrode G3 is spaced by two or more times a regular interval between two adjacent stem pins from adjacent stem pins for applying low voltages to prevent arcing between the high-voltage stem pin and the low-voltage stem pins, and for this reason no stem pins are embedded in the stem pin position #3, #4, #13 and #14.

In FIGS. 6A and 7, only the three stem pins 341, 342, 343 are shown for the sake of clarity, but it will be understood that in practice there are other stem pins for introducing into the neck portion 22 signals such as a video signal and voltages for forming and focusing of the electron beams 30, as explained in connection with FIG. 6D.

In FIG. 7, the cathode 31, the beam control electrode G1, the accelerating electrode G2, the focus electrode G3, the anode G4, the heater 32, and the bead glasses 33A and 33B are the constituent parts of the in-line type electron gun 29, and the stem pins 341, 342, 343, the mount supports 35A, 35B, the supporting member 36 form the electron gun supporting structure 38.

As shown in FIGS. 6B and 7, mounds 37 are formed integrally with a disk portion of the stem 28 at the stem pin positions #1 to #14, and the stem pins including the stem pins 341, 342 and 343 are sealed perpendicularly to and through the disk portion and the mounds 37 of the stem 28 at all the stem pin positions excluding the stem pin positions #3, #4, #13 and #14.

As shown in FIG. 6B, the in-line type electron gun 29 are mounted on the stem 28 such that the pair of bead glasses 33A and 33B indicated by broken lines are parallel with a line connecting the stem pins 341 and 342 embedded at the stem pin positions #11 and #8, respectively. A pair of mount supports 35B and 35A welded to the two stem pins 341 and 342, respectively, are embedded in the bead glass 33A at their ends of the mount supports 35B and 35A. The other bead glass 33B has another mount support 35B embedded therein such that the mount support 35B is positioned symmetrically with the mount support 35A welded to the stem pin 342 with respect to the axis X—X.

The two mount supports 35B and 35A corresponding to the two stem pins 341, 342 are directly welded to the two stem pins 341, 342 at their respective ends protruding from the bead glass 33A. The mount support 35B embedded in the bead glass 33B cannot be welded directly to any stem pins because no stem pins are embedded in the stem pin positions #3 and #4 near the mount support 35B for prevention of arcing as explained above, and therefore the end of the mount support 35B protruding from the bead glass 33B is welded to the stem pin 343 embedded at the stem pin position #5 via the supporting member 36.

FIGS. 6E and 6F are enlarged perspective views of the mount supports 35A and 35B, respectively.

As shown in FIG. 6C, the supporting member 36 has a generally C-shaped transverse cross section, and comprises a plate-like portion 360 and first and second bent portions 361 and 362 bent in the same direction from the respective sides of the plate-like portion 360. The first and second bent portions 361, 362 are welded to the mount support 35B and the stem pin 343, respectively.

With the electron gun supporting structure 38 of the above configuration, the in-line type electron gun 29 is supported on the stem 28 within the neck portion 22 of the color cathode ray tube.

When the conventional color cathode ray tube is subjected to a great shock, the shock is transmitted to the in-line type electron gun 29 housed within the neck portion 22, and the electron gun supporting structure 38 cannot withstand the increased weight of the in-line type electron gun 29 due to the shock and as a result, the electron gun supporting structure 38 is sometimes deformed such that the in-line type electron gun 29 is deviated from its specified position within the neck portion 22.

FIGS. 8A and 8B illustrate an example of a case where the in-line type electron gun 29 is deviated from its specified position within the neck portion 22, FIG. 8A is a broken-away side view of the neck portion 22 containing the in-line type electron gun 29, and FIG. 8B is an enlarged side view of the deformed supporting member 36.

If the in-line type electron gun 29 is deviated from its specified position within the neck portion 22 as shown in FIG. 8A, chiefly the first bent portion 361 of the supporting member 36 is bent slightly outwardly as indicated by solid lines from its specified position indicated by broken lines in FIG. 8B. As a result, a shield cup 291 nearest to the phosphor screen 24 (see FIG. 5), of the in-line electron gun 29, contacts the inner wall of the neck portion 22 and scrapes off the graphite 50 coated on the inner wall of the neck portion 22. If flakes of the scraped-off graphite 50 lodge fall the in-line type electron gun 29, and become attached to the constituent components of the in-line type electron gun 29, the flakes of the graphite 50 lower the dielectric strength of the in-line type electron gun 29, and cause the in-line electron type electron gun 29 to be defective in dielectric withstand-voltage.

It is true that the supporting strength of the in-line type electron gun 29 by the electron gun supporting structure 38 is increased by bringing closer to the stem mounds 37 the weld points between the stem pins 341, 342 and the mount supports 35B, 35A and the weld point between the stem pin 343 and the second bent portion 362 of the supporting member 36, respectively, but this increases the possibility that cracks occur in the mounds 37 of the stem 28 and consequently, the manufacturing yield rate of the in-line type electron gun 29 is reduced.

SUMMARY OF THE INVENTION

The present invention is made in view of the above technical background, and it is an object of the present invention to provide a cathode ray tube capable of increasing the supporting strength of the electron gun without reducing the dielectric strength of the electron gun or lowering the manufacturing yield rate of the electron gun, by using a simple means.

To achieve the above objects, in accordance with an embodiment of the present invention, there is provided a cathode ray tube comprising: a vacuum envelope including a panel portion having a phosphor screen on an inner surface thereof, a neck portion, a funnel portion connecting the panel portion and the neck portion, and a stem closing the neck portion at one end thereof and having a circular array of stem pins sealed therethrough; an electron gun housed in the neck portion, the electron gun including a plurality of electrodes coaxially fixed on a pair of bead glasses; a plurality of mount supports embedded in end portions of the pair of bead glasses for supporting the electron gun on the stem; and a supporting member for connecting one of the stem pins and one of the plurality of mount supports, the supporting member including a plate-like portion, first and second bent portions bent from respective sides of the plate-like portion in a same direction to form a generally C-shaped transverse cross section, the first bent portion being welded to the one of the plurality of mount supports, the second bent portion being welded to the one of the stem pins, and a length of the plate-like portion on a first-bent-portion side thereof in a direction of an axis of the electron gun being longer than a length of the plate-like portion on a second-bent-portion side thereof in the direction of the axis of the electron gun.

With this configuration of the present invention, the entire region of the first bent portion of the supporting member having a generally C-shaped cross section is reinforced by lengthening the length of its plate-like portion in the direction of the electron gun axis, and consequently, even if the electron gun supported by the electron gun supporting structure is subjected to a great shock, the first bent portion of the electron gun supporting structure is capable of sufficiently withstanding the increased weight of the electron gun due to the shock and the electron gun supporting structure is not deformed.

Because the electron gun supporting structure is not deformed and the electron gun is not deviated from its specified position within the neck portion of the cathode ray tube, the graphite coated on the inner wall of the neck portion is not scraped off, and as a result, the dielectric strength of the electron gun is not lowered by the scraped-off graphite attached to the electron gun. Further, the weld points of the stem pins do not need to be brought closer to the mounds of the stem, and consequently, cracks do not occur in the mounds of the stem, or the manufacturing yield rate of the electron gun is not reduced.

BRIEF DESCRIPTION OF THE DRAWINGS

In the accompanying drawings, in which like reference numerals designate similar components throughout the figures, and in which:

FIG. 8A is a broken-away side view of the neck portion containing the in-line type electron gun, and FIG. 8B is an enlarged side view of the deformed supporting member.

DETAILED DESCRIPTION OF THE PREFERRED EMBODIMENTS

Now the embodiments of the present invention will be explained by reference to the drawings.

Figure 1:
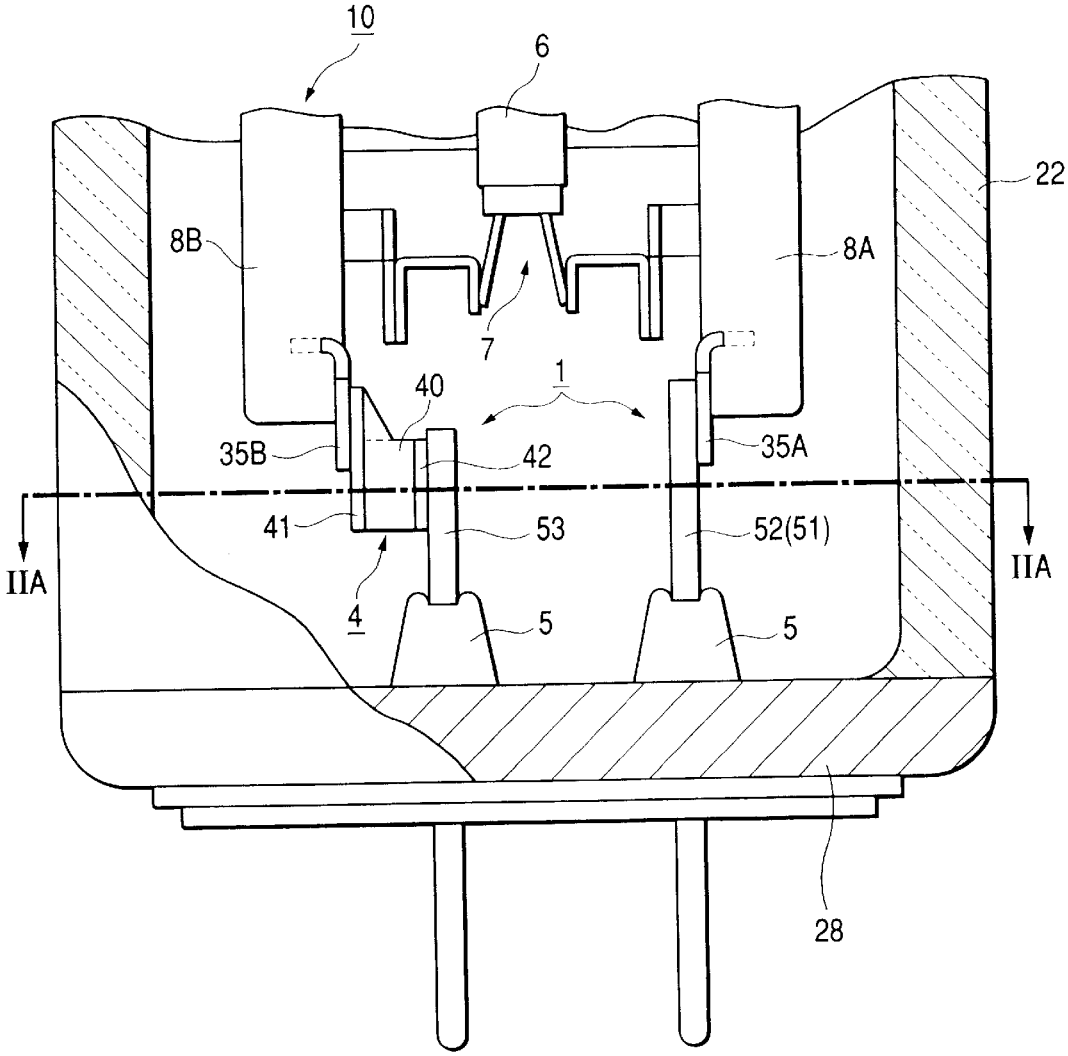
FIG. 1 is a broken-away side view of a neck portion of a cathode ray tube in accordance with an embodiment of the present invention.

FIG. 1 is a broken-away side view of a neck portion of a cathode ray tube in accordance with an embodiment of the present invention.

Figure 7:
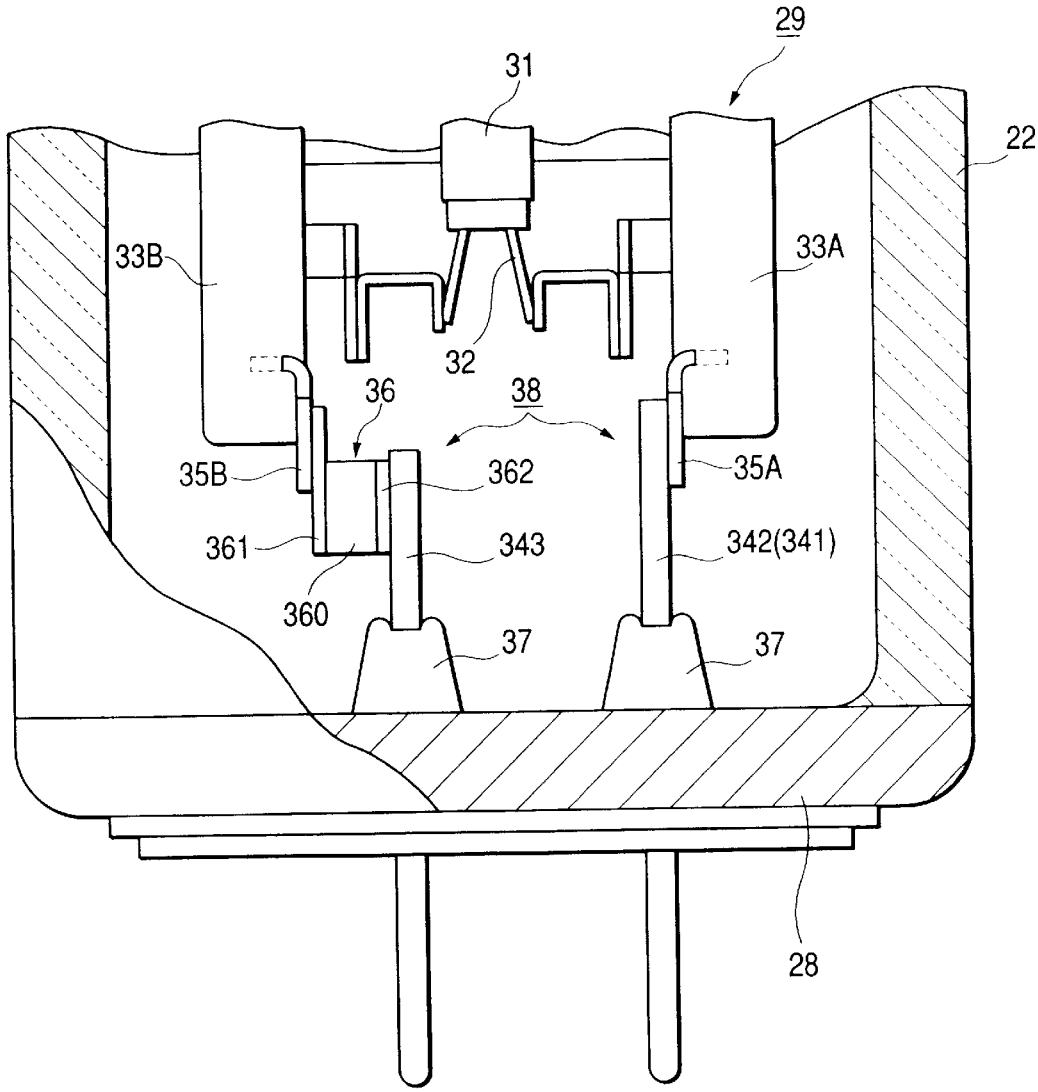
FIG. 7 is an enlarged side view of the in-line type electron gun of FIG. 6A supported on a stem by an electron gun supporting structure.
Figure 8A:
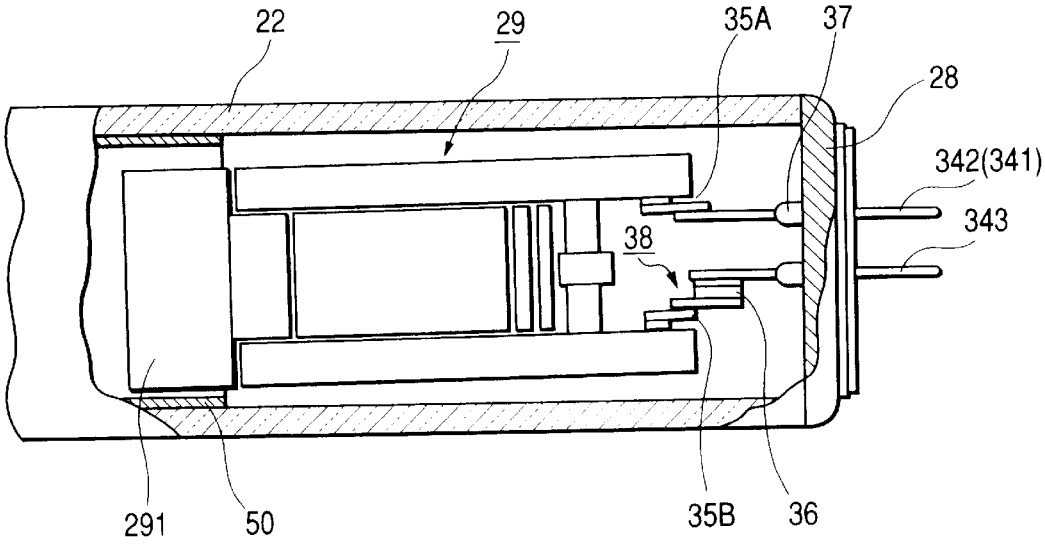
FIGS. 8A and 8B illustrate an example of a case where the in-line type electron gun is deviated from its specified position within the neck portion.
Figure 8B:
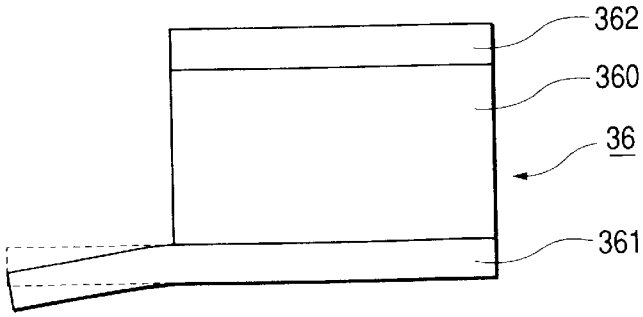

In FIG. 1, reference numeral 1 denotes an electron gun supporting structure, 51, 52 and 53 are stem pins, 35A and 35B are mount supports, 4 is a supporting member having a generally C-shaped cross section, 40 is a plate-like portion of the supporting member 4, 41 is a first bent portion of the supporting member 4, 42 is a second bent portion of the supporting member 4, 28 is a stem, 5 are mounds of the stem 28, 6 is a cathode, 7 is a heater, and 8A and 8B are a pair of bead glasses. FIG. 1 is a view similar to that of FIG. 7 already explained. In this embodiment also, an in-line type electron gun 10 is comprised of the cathode 6, the beam control electrode G1, the accelerating electrode G2, the focus electrode G3 and the anode G4 (which are not shown) coaxially arranged and fixed on the pair of bead glasses 8A and 8B with their respective support tabs embedded in the bead glasses 8A and 8B.

In FIG. 1, only the three stem pins 51, 52, 53 are shown for the sake of clarity, but it will be understood that in practice there are other stem pins for introducing into the neck portion 22 signals such as a video signal and voltages for forming and focusing of the electron beams.

The positions of the respective stem pins are arranged with an equal angular spacing of 25.7° on a pin circle of 15.24 mm in diameter, and the stem pins embedded in the respective stem pin positions are connected to the electrodes of the in-line type electron gun as shown in Table 1 above.

The electron gun supporting structure 1 comprises the three stem pins 51, 52, 53, the three mount supports 35A, 35B, 35B corresponding to the three stem pins 51, 52, 53, respectively, and the supporting member 4 having a generally C-shaped cross section and connected between the stem pin 53 and the mount supports 35B. The supporting member 4 comprises the plate-like portion 40, the first bent portion 41 and the second bent portion 42.

Figure 2A:
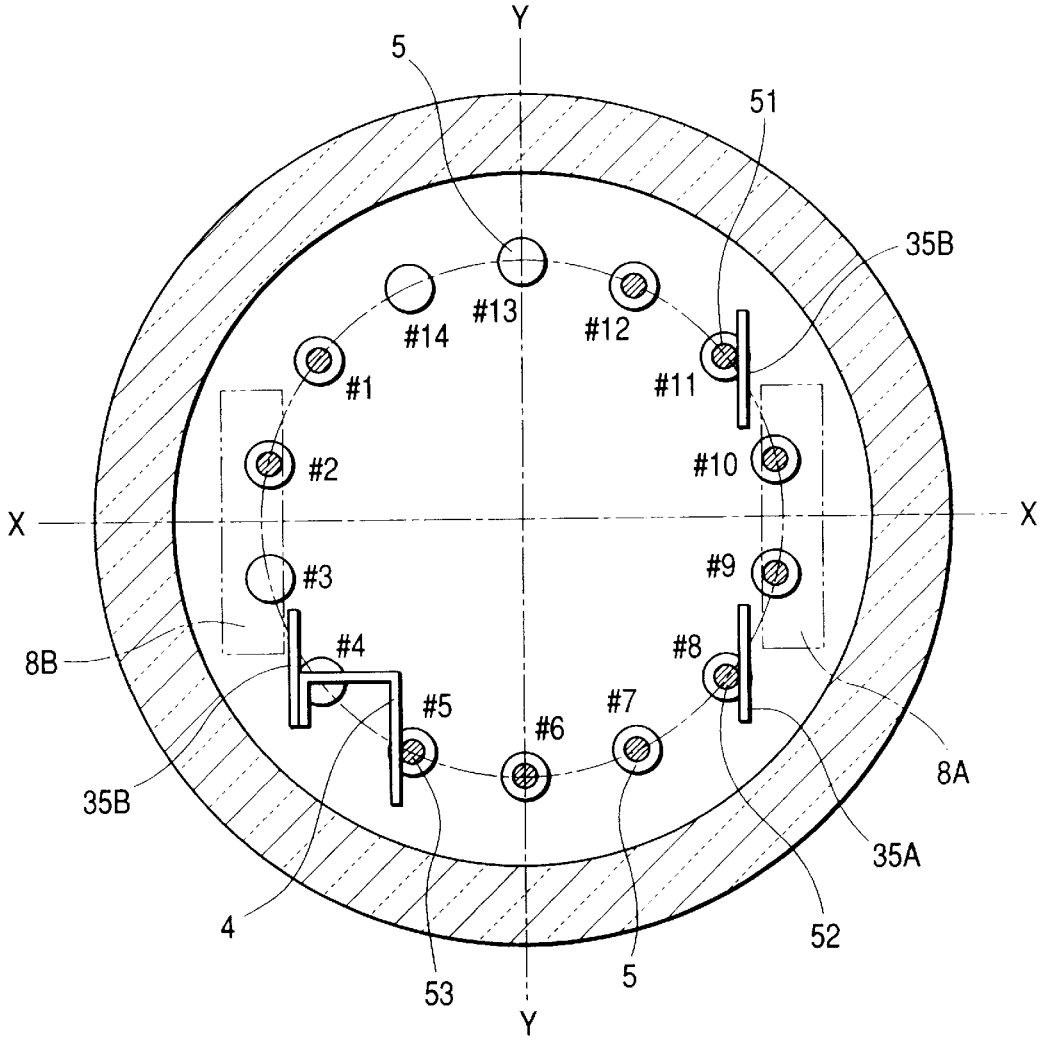
FIG. 2A is a cross-sectional view of the neck portion taken along line IIA—IIA of FIG. 1.
Figure 2B:
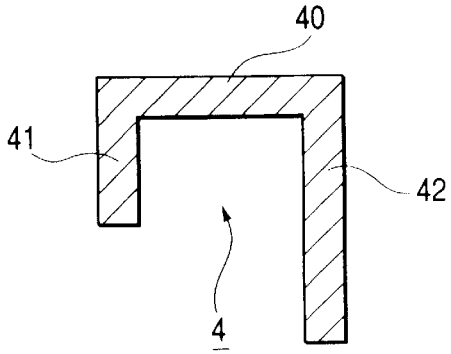
FIG. 2B is an enlarged cross-sectional view of a supporting member taken along line IIA—IIA of FIG. 1.

FIG. 2A is a cross-sectional view of the neck portion 22 taken along line IIA—IIA of FIG. 1, and FIG. 2B is an enlarged cross-sectional view of the supporting member 4 taken along line IIA—IIA of FIG. 1. The same reference numerals as utilized in FIG. 1 designate corresponding constituent elements in FIGS. 2A and 2B.

As shown in FIGS. 1 and 2A, mounds 5 are formed integrally with a disk portion of the stem 28 at the stem pin positions #1 to #14, and the stem pins including the stem pins 51, 52 and 53 are sealed perpendicularly to and through the disk portion and the mounds 5 of the stem 28 at all the stem pin positions excluding the stem pin positions #3, #4, #13 and #14.

As shown in FIG. 2A, the in-line type electron gun 10 are mounted on the stem 28 such that the pair of bead glasses 8A and 8B indicated by broken lines are parallel with a line connecting the stem pins 51 and 52 embedded at the stem pin positions #11 and #8, respectively. A pair of mount supports 35B and 35A welded to the two stem pins 51 and 52, respectively, are embedded in the bead glass 8A at their ends of the mount supports 35B and 35A. The other bead glass 8B has another mount support 35B embedded therein such that the mount support 35B is positioned symmetrically with the mount support 35A welded to the stem pin 52 with respect to the axis Y—Y.

The two mount supports 35B and 35A corresponding to the two stem pins 51, 52 are directly welded to the two stem pins 51, 52 at their respective ends protruding from the bead glass 8A. The mount support 35B embedded in the bead glass 8B cannot be welded directly to any stem pins because no stem pins are embedded in the stem pin positions #3 and #4 near the mount support 35B for prevention of arcing as explained above, and therefore the end of the mount support 35B protruding from the bead glass 8B is welded to the stem pin 53 embedded at the stem pin position #5 via the supporting member 4.

The two mount supports 3 corresponding to the two stem pins 51, 52 are directly welded to the two stem pins 51, 52 at their respective ends protruding from the one of the bead glasses 8, and the other mount support 3 corresponding to the stem pin 53 is welded to the stem pin 53 at its end protruding from the other of the two bead glasses 8 via the supporting member 4.

As shown in FIG. 2B, the supporting member 4 having a generally C-shaped cross section and comprises an interconnecting plate-like portion 40, and first and second bent portions 41 and 42 formed by being bent in the same direction from the respective sides of the plate-like portion 40. The first and second bent portions 41, 42 are welded to the mount support 35B and the stem pin 53, respectively.

The length of the first bent portion 41 in the axial direction of the electron gun 10 is longer than the length of the second bent portion 42 in the axial direction. The length of the plate-like portion 40 in the axial direction is configured such that the axial length of the plate-like portion 40 on its first-bent-portion 41 side is longer than that of the plate-like portion 40 on its second-bent-portion 42 side corresponding to the axial lengths of the first and second bent portions 41, 42. The axial length of the plate-like portion 40 is equal to the axial length of the second bent portion 42 in a region from its second-bent-portion 42 side to approximately the midpoint of the width of the plate-like portion 40, and then the axial length of the plate-like portion 40 increases linearly with distance in the direction of its width in a region from approximately the midpoint of its width to its first-bent-portion 41 side. In this supporting member 4 having the generally C-shaped cross section, a portion of the plate-like portion 40 above the broken line indicated in FIG. 1 forms a support-reinforcing region for the first bent portion 41.

The electron gun supporting structure 1 of this configuration supports the in-line type electron gun 10 on the stem 28 within the neck portion 22 of the color cathode ray tube.

If a great shock was applied to the color cathode ray tube employing the electron gun supporting structure 1 for some reason or other, the shock is transmitted to the in-line type electron gun housed within the neck portion. Although the weight greater than the actual weight of the in-line type electron gun is applied to the electron gun supporting structure 1 momentarily due to the shock applied to the in-line type electron gun, the first bent portion 41 is capable of withstanding the greater weight because the support-reinforcing region for the first bent portion 41 is formed in the plate-like portion 40, therefore no deformation occurs, and consequently, the in-line type electron gun is not deviated from its specified position within the neck portion.

Because the in-line type electron gun is not deviated from its specified position within the neck portion, the in-line type electron gun does not contact the inner wall of the neck portion, therefore the graphite coated on the inner wall of the neck portion is not scraped off by the in-line type electron gun, and consequently, the dielectric strength of the in-line type electron gun is not reduced by the scraped-off graphite flakes adhering to the inside of the in-line type electron gun, and as a result, the withstand voltage of the in-line type electron gun is sufficiently maintained at all times.

In the embodiment shown in FIG. 1, the shape of the plate-like portion 40 of the supporting member 4 having the generally C-shaped cross section is such that the axial length of the plate-like portion 40 is equal to the axial length of the second bent portion 42 in a region from its second-bent-portion 42 side to approximately the midpoint of the width of the plate-like portion 40, and then the axial length of the plate-like portion 40 increases linearly with distance in the direction of its width in a region from approximately the midpoint of its width to its first-bent-portion 41 side. However, the shape of the plate-like portion 40 in accordance with the present invention is not limited to the above configuration, but other shapes of the plate-like portion 40 will suffice if they are configured such that the length of the plate-like portion 40 in the axial direction of the electron gun on its first-bent-portion 41 side is longer than that of the plate-like portion 40 on its second-bent-portion 42 side, and the shapes of the plate-like portion 40 as shown in FIGS. 3A and 3B, for example, provide the advantages of the present invention.

Figure 3A:
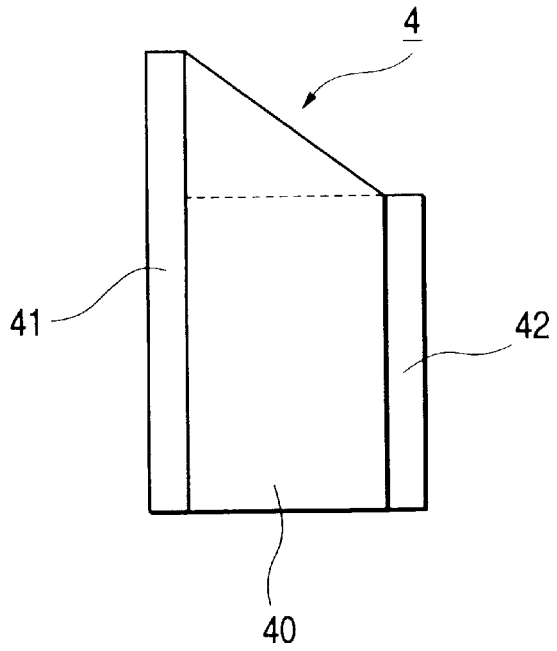
FIGS. 3A and 3B are side views of other two examples of the supporting member having a generally C-shaped cross section useful for the embodiment shown in FIG. 1.
Figure 3B:
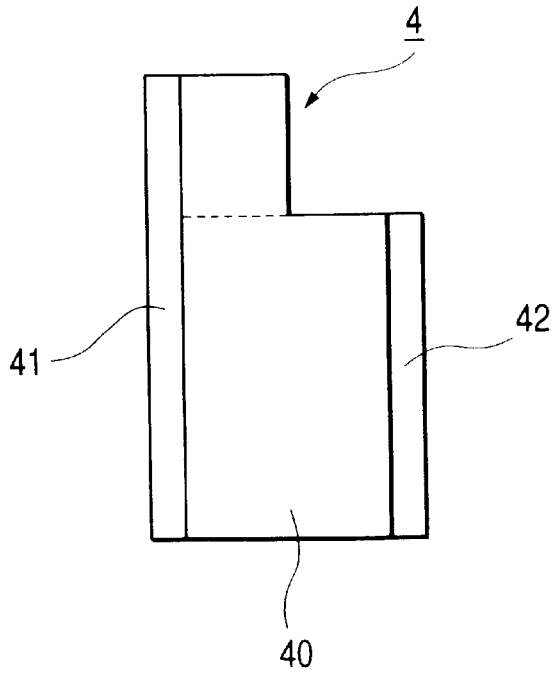

FIGS. 3A and 3B are side views of other two examples of the supporting member 4 having a generally C-shaped cross section useful for the embodiment shown in FIG. 1.

In a first one of the two examples of the supporting member 4 shown in FIG. 3A, the length of the plate-like portion 40 in the direction of the electron gun axis increases linearly with distance in the direction of its width from its second-bent-portion 42 side to its first-bent-portion 41 side, that is, the length of the plate-like portion 40 in the direction of the electron gun axis increases linearly with distance throughout the entire width in the direction of its width.

In a second one of the two examples of the supporting member 4 shown in FIG. 3B, the length of the plate-like portion 40 in the direction of the electron gun axis is equal to the axial length of the second bent portion 42 in a region from its second-bent-portion 42 side to approximately the midpoint of the width of the plate-like portion 40, and then the axial length of the plate-like portion 40 is equal to the axial length of the first bent portion 41 in a region from approximately the midpoint of the width of the plate-like portion 40 to its first-bent-portion 41 side, that is, the length of the plate-like portion 40 in the direction of the electron gun axis changes stepwise at approximately the midpoint of the width of the plate-like portion 40.

Although, in the examples of FIGS. 3A and 3B, the axial length of the plate-like portion 40 varies linearly or stepwise, it is needless to say that the plate-like portion 40 having its axial length changing curvilinearly provides the advantages of the present invention also.

The supporting members 4 having the above configurations are provided with portions of the plate-like portion 40 above the broken lines indicated in FIGS. 3A and 3B serving as support-reinforcing regions for the first bent portion 41, and consequently, the supporting members 4 can increase the supporting strength of the in-line type electron gun by the electron gun supporting structure 1 as in the case of the embodiment shown in FIG. 1 employing the supporting member 4 having a generally C-shaped cross section.

Figure 4:
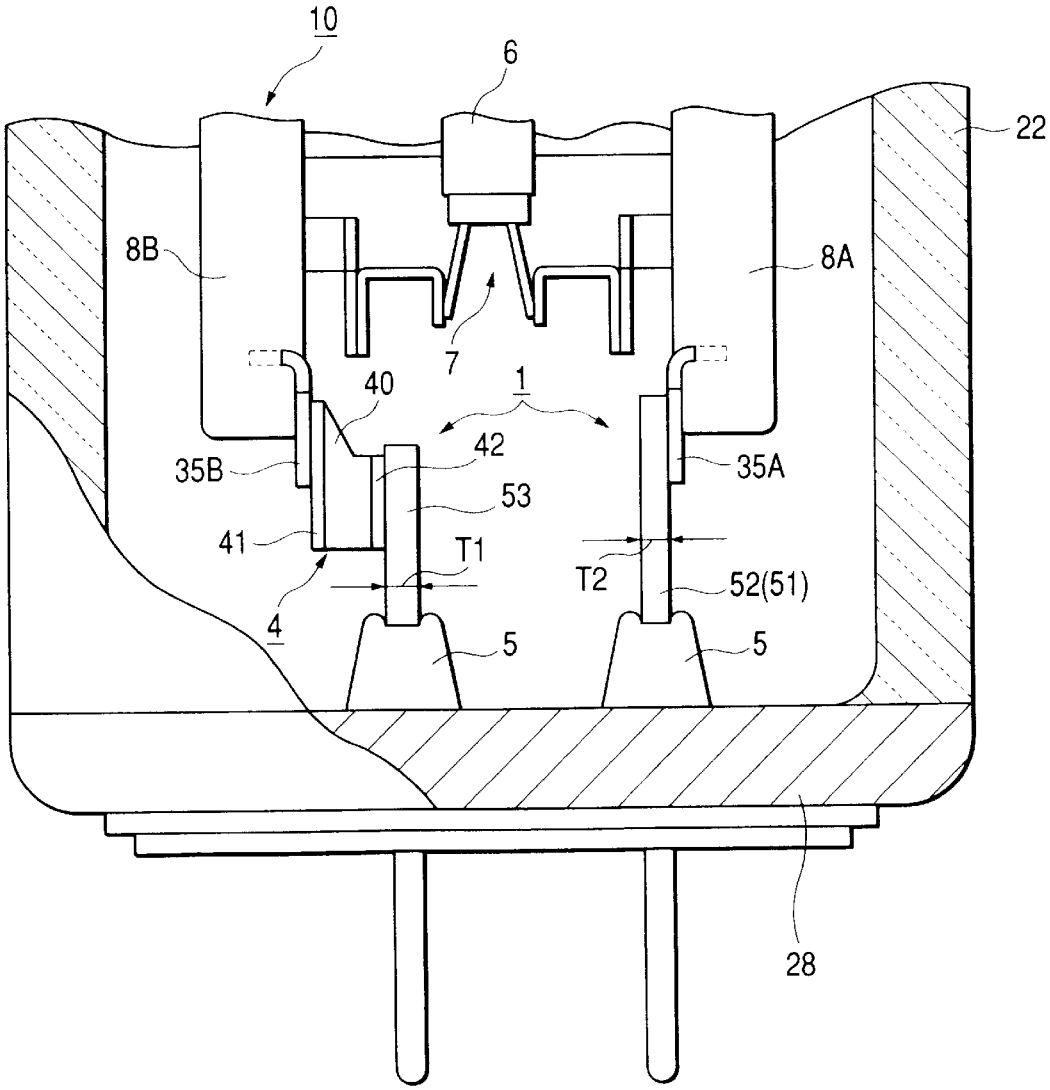
FIG. 4 is a broken-away side view of a neck portion of a cathode ray tube in accordance with another embodiment of the present invention.
Figure 5:
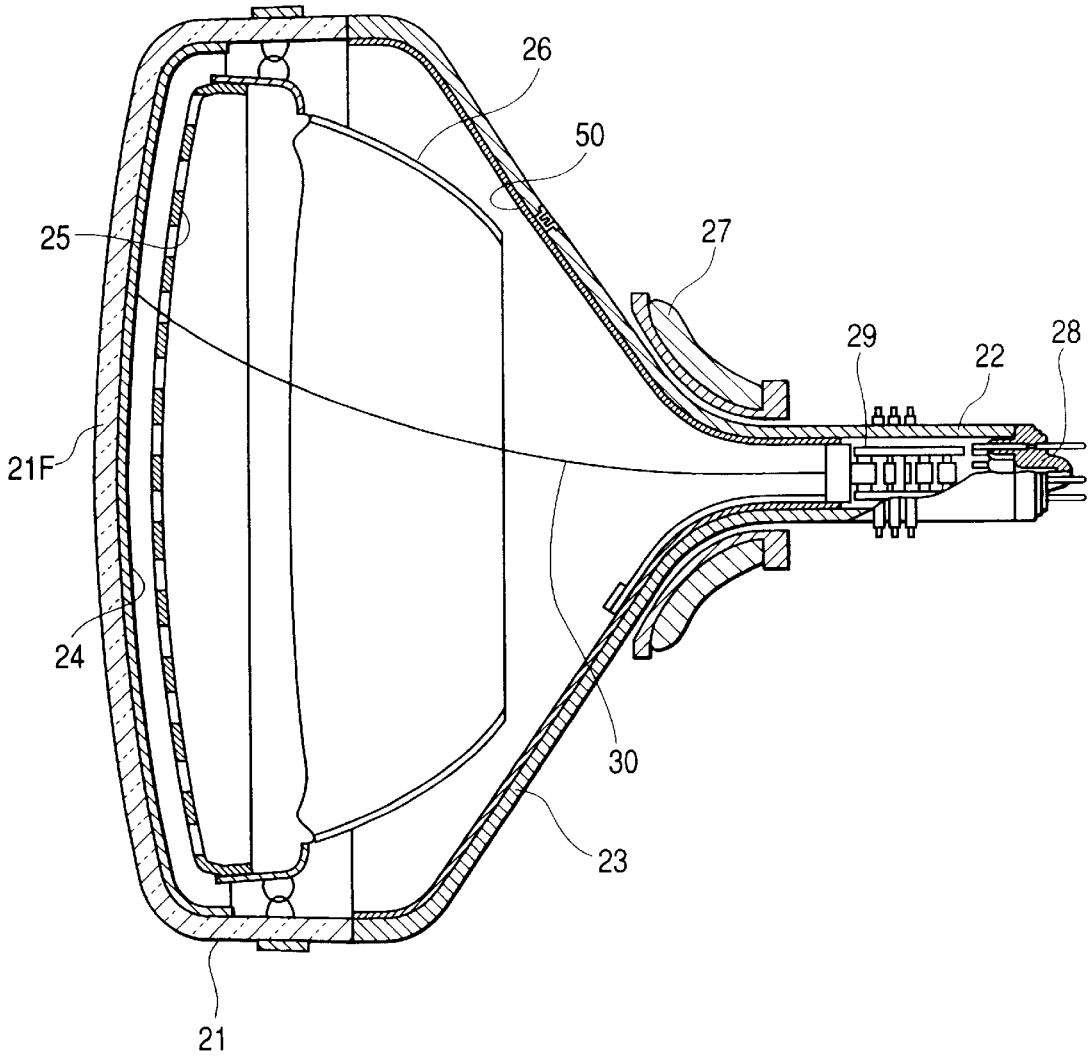
FIG. 5 PRIOR ART
FIG. 5 is a schematic cross-sectional view of a conventional color cathode ray tube.
Figure 6A:
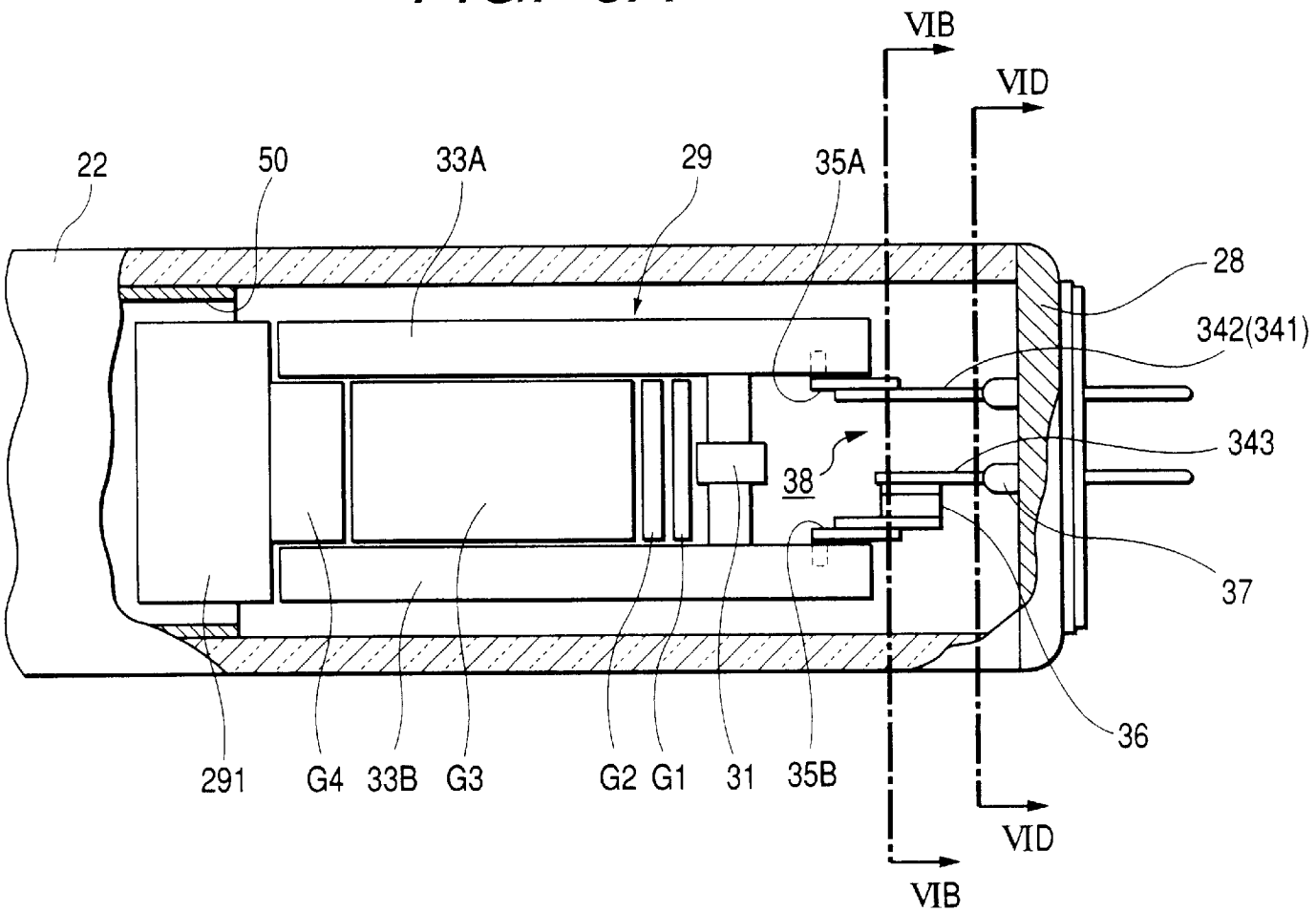
FIG. 6A is a broken-away side view of the neck portion of the conventional color cathode ray tube housing the in-line type electron gun.
Figure 6B:
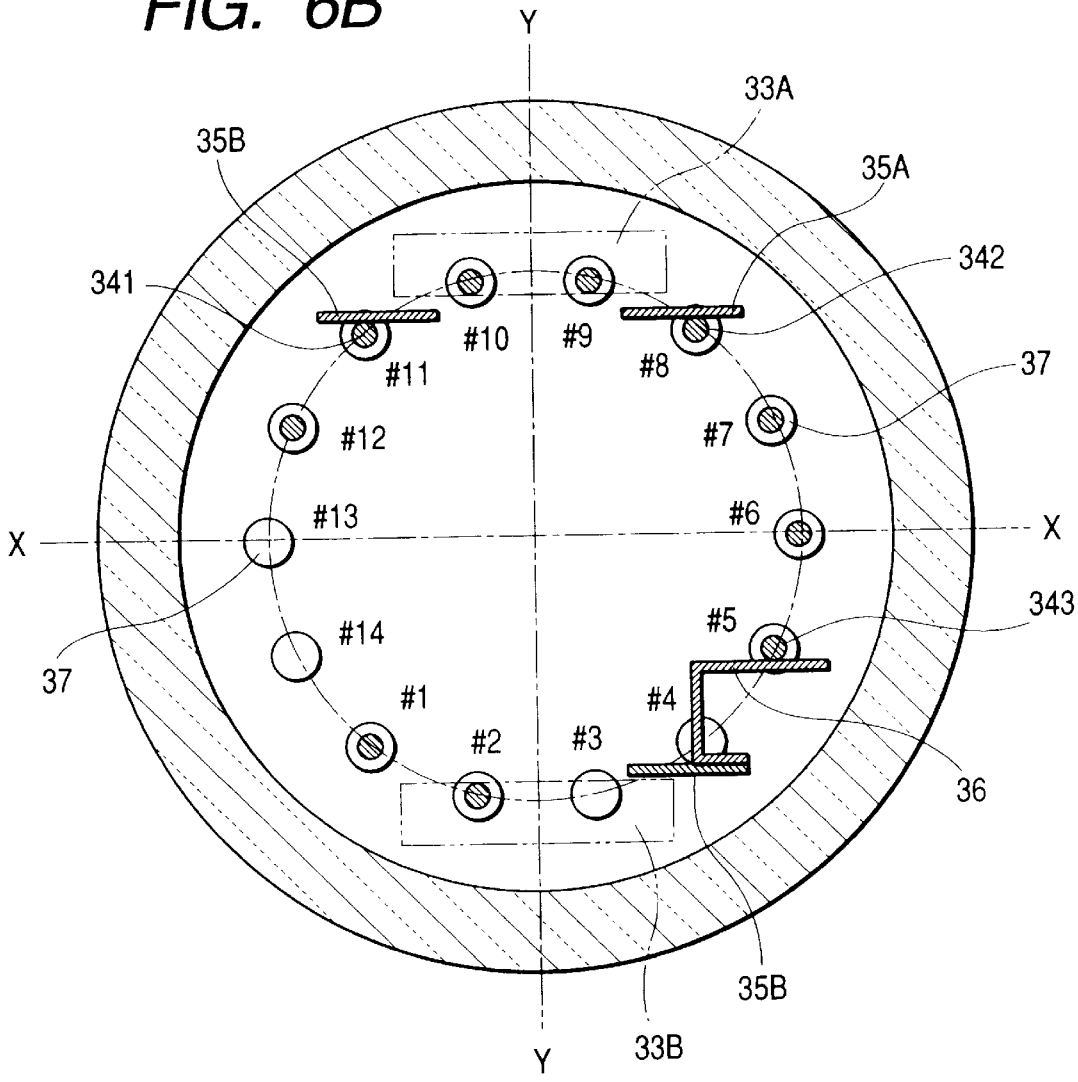
FIG. 6B is an enlarged cross-sectional view of the neck portion 22 taken along line VIB—VIB of FIG. 6A.
Figure 6C:
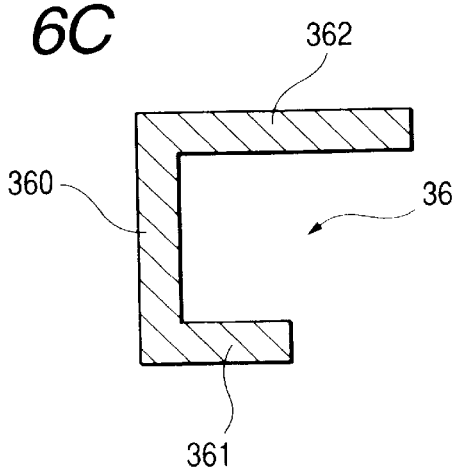
FIG. 6C is an enlarged cross-sectional view of a supporting member taken along line VIB—VIB of FIG. 6A.
Figure 6D:
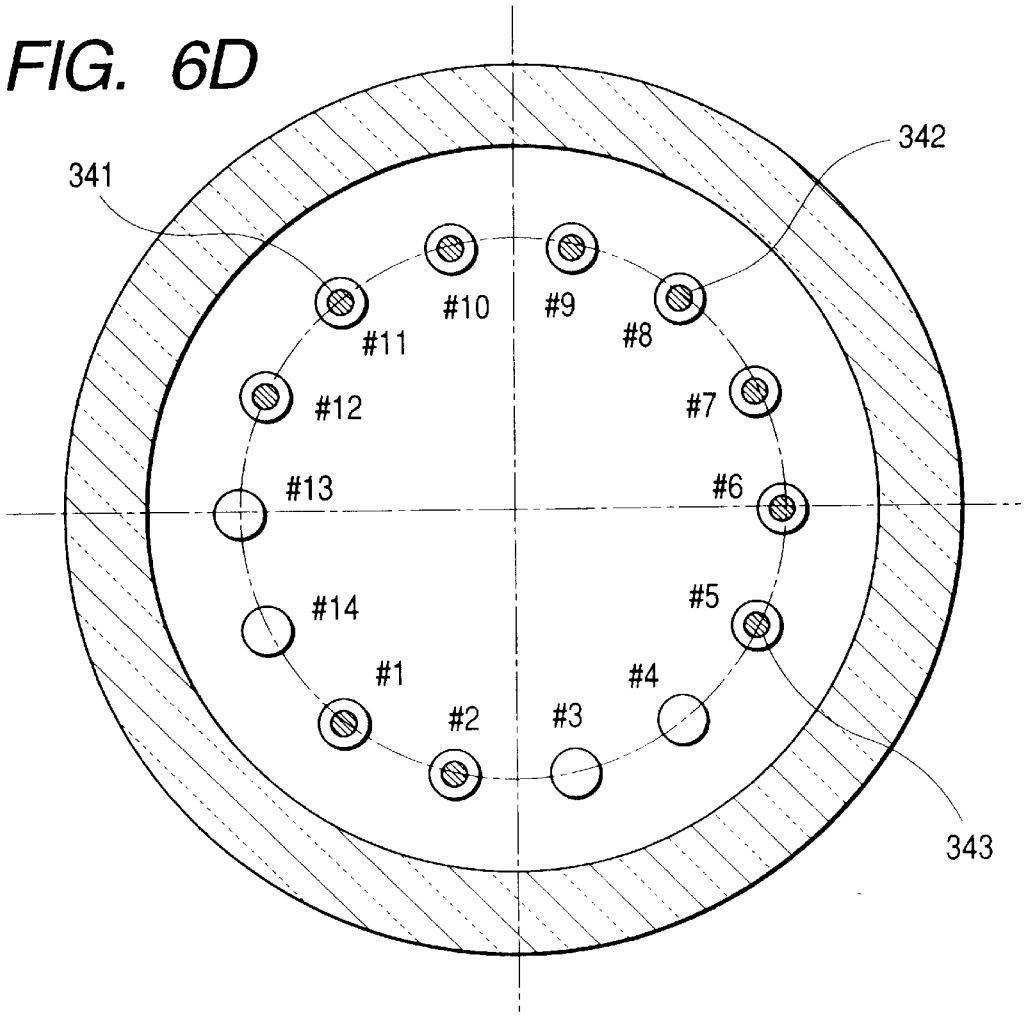
FIG. 6D is an enlarged cross-sectional view of the neck portion 22 taken along line VID—VID of FIG. 6A, and FIGS. 6E and 6F are an enlarged perspective views of two different mount supports.
Figure 6E:
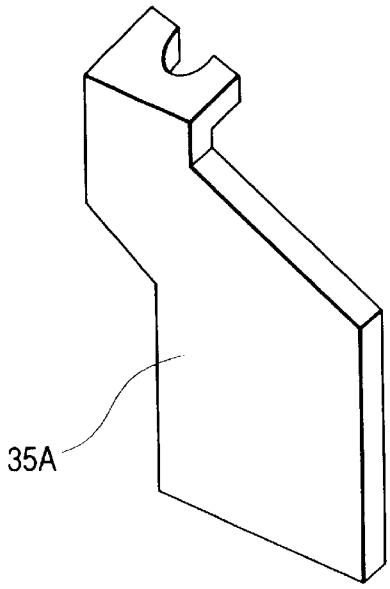
Figure 6F:
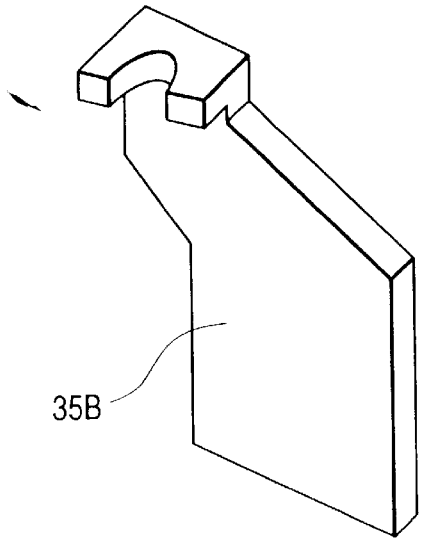

FIG. 4 is a broken-away side view of a neck portion of a cathode ray tube in accordance with another embodiment of the present invention.

The same reference numerals as utilized in FIG. 1 designate corresponding constituent elements in FIG. 4.

The embodiment shown in FIG. 4 is identical in configuration with the embodiment shown in FIG. 1, except that, in the embodiment of FIG. 4, the diameter T1 of the stem pin 53 within the cathode ray tube is selected to be larger than the diameter T2 of the other stem pins 51 and 52 within the cathode ray tube, while the diameters of the three stem pins 51, 52 and 53 within the cathode ray tube are selected to be the value T2 in the embodiment of FIG. 1. Therefore the further explanation of the embodiment of FIG. 4 is omitted.

In the embodiment shown in FIG. 4, the diameter T1 of the stem pin 53 to which the supporting member 4 having a generally C-shaped cross section is welded is selected to be larger within the cathode ray tube than the diameter T2 of the other two stem pins 51, 52 within the cathode ray tube, and consequently, this configuration can increase the supporting strength of the in-line type electron gun by the electron gun supporting structure 1 further in cooperation with the support-reinforcing region for the first bent portion 41.

In the above embodiments, the electron gun supporting structures 1 have been explained as supporting the in-line type electron gun of the color cathode ray tube, however, the electron gun supporting structure 1 in accordance with the present invention is not limited to means for supporting the in-line type electron gun of the color cathode ray tube, but is similarly applicable to means for supporting an electron gun of cathode ray tubes of other types.

As described above, in the present invention, the entire region of the first bent portion of the supporting member 4 having a generally C-shaped cross section is reinforced by lengthening the length of its plate-like portion in the direction of the electron gun axis, and consequently, even if the electron gun supported by the electron gun supporting structure is subjected to a great shock, the first bent portion of the electron gun supporting structure is capable of sufficiently withstanding the increased weight of the electron gun due to the shock and the electron gun supporting structure is not deformed.

Because the electron gun supporting structure is not deformed and the electron gun is not deviated from its specified position within the neck portion of the cathode ray tube, the graphite coated on the inner wall of the neck portion is not scraped off, and as a result, the dielectric strength of the electron gun is not lowered by the scraped-off graphite attached to the electron gun. Further, the weld points of the stem pins do not need to be brought closer to the mounds of the stem, and consequently, cracks do not occur in the mounds of the stem, or the manufacturing yield rate of the electron gun is not reduced.

What is claimed is:

1. A cathode ray tube comprising:

a vacuum envelope including a panel portion having a phosphor screen on an inner surface thereof, a neck portion, a funnel portion connecting said panel portion and said neck portion, and a stem closing said neck portion at one end thereof and having a circular array of stem pins sealed therethrough;

an electron gun housed in said neck portion, said electron gun including a plurality of electrodes coaxially fixed on a pair of bead glasses;

a plurality of mount supports embedded in end portions of said pair of bead glasses for supporting said electron gun on said stem; and a supporting member for connecting one of said stem pins and one of said plurality of mount supports, said supporting member including a plate-like portion, first and second bent portions bent from respective sides of said plate-like portion in a same direction to form a generally C-shaped transverse cross section, said first bent portion being welded to said one of said plurality of mount supports, said second bent portion being welded to said one of said stem pins, and a length of said plate-like portion on a first-bent-portion side thereof in a direction of an axis of said electron gun being longer than a length of said plate-like portion on a second-bent-portion side thereof in the direction of the axis of said electron gun.

2. A cathode ray tube according to claim 1, wherein said length of said plate-like portion in the direction of the axis of said electron gun is equal to a length of said second bent portion in the direction of the axis of said electron gun in a region from said second-bent-portion side to approximately a midpoint of a width of said plate-like portion, and then said length of said plate-like portion in the direction of the axis of said electron gun increases linearly with distance in a direction of the width from approximately the midpoint of the width to said first-bent-portion side.

3. A cathode ray tube according to claim 1, wherein said length of said plate-like portion in the direction of the axis of said electron gun increases linearly with distance in a direction of a width of said plate-like portion.

4. A cathode ray tube according to claim 1, wherein said length of said plate-like portion in the direction of the axis of said electron gun increases curvilinearly with distance in a direction of a width of said plate-like portion.

5. A cathode ray tube according to claim 1, wherein said length of said plate-like portion in the direction of the axis of said electron gun increases stepwise with distance in a direction of a width of said plate-like portion.

* * * * *